US006910925B2

(12) United States Patent
Endo et al.

(10) Patent No.: US 6,910,925 B2
(45) Date of Patent: Jun. 28, 2005

(54) FEMALE TERMINAL, CONNECTING STRUCTURE THEREOF, AND WIRE HARNESS

(75) Inventors: Takayoshi Endo, Haibara-gun (JP); Takashi Ishii, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 7 days.

(21) Appl. No.: 10/441,238

(22) Filed: May 20, 2003

(65) Prior Publication Data

US 2004/0009714 A1 Jan. 15, 2004

(30) Foreign Application Priority Data

May 20, 2002 (JP) ..... P2002-145247

(51) Int. Cl.[7] ..... H01R 11/22
(52) U.S. Cl. ..... 439/856
(58) Field of Search ..... 439/856, 852, 439/876, 851, 857, 858, 861, 744

(56) References Cited

U.S. PATENT DOCUMENTS 4,564,259 A * 1/1986 Vandame ..... 439/852
5,443,592 A * 8/1995 Ittah et al. ..... 439/851
5,630,738 A * 5/1997 Ito et al. ..... 439/852
6,024,612 A * 2/2000 Myer et al. ..... 439/852
6,203,385 B1 * 3/2001 Sato et al. ..... 439/852
6,283,802 B1 9/2001 Sato et al.
6,386,928 B2 * 5/2002 Kitamura ..... 439/852

FOREIGN PATENT DOCUMENTS

DE 698 06 224 T2 10/2002
EP 1 089 387 A2 4/2001

* cited by examiner

*Primary Examiner*—J. F. Duverne
(74) *Attorney, Agent, or Firm*—Sughrue Mion, PLLC

(57) ABSTRACT

A female terminal includes a terminal body, comprised of a first material having excellent corrosion resistance and an elastic piece, comprised of a second material having excellent spring properties, and the elastic piece mounting on the terminal body. An engagement portion is formed on the terminal body. A retaining portion is formed on the elastic piece. The retaining portion is engaged with the engagement portion so that the elastic piece is mounted on the terminal body.

21 Claims, 3 Drawing Sheets

FEMALE TERMINAL, CONNECTING STRUCTURE THEREOF, AND WIRE HARNESS

BACKGROUND OF THE INVENTION

This invention relates to a female terminal with improved corrosion resistance, a connecting structure of the female terminal suited for connection, for example, to an aluminum wire, and a wire harness which is enhanced in connection performance by using this female terminal.

FIG. 4 is a perspective view showing one related electric connection member described in JP-A5-47429.

The electric connection member, shown in FIG. 4, is in the form of a connection terminal, and this electric connection member includes a conductor clamping portion 51 for receiving and holding a conductor 50 of an end-processed cable 49, an insulator clamping portion 55 provided rearwardly of the conductor clamping portion 51 so as to receive and hold an insulator 52 of the end-processed cable 49, and a fitting portion 54 provided forwardly of the conductor clamping portion 51 (that is, at a distal end portion) so as to fit on a mating terminal (i.e., a mating connection member) (not shown) to be electrically connected thereto. The electric connection member, shown in FIG. 4, is in the form of a female terminal, while the mating connection member (not shown) is in the form of a male terminal.

Projections 56 are formed on an inner side of the insulator clamping portion 55 of the electric connection member, and when the insulator clamping portion 55 is press-fastened on an outer surface of the insulator 52, these projections 52 are pressed against the insulator 52. The length of the insulator clamping portion 55 in a direction of the outer periphery of the insulator 52 is smaller than the length of the outer periphery of the insulator 52.

Generally, a copper wire is used as a wire for a wire harness, and a plurality of copper wires or cables are bundled together to form a wire harness. A connection terminal for connection to such a copper wire is formed by a copper sheet or a copper alloy sheet.

In the above related connection terminal, however, when a so-called aluminum wire is used as the cable 49 for a wire harness (in which case the conductor 50 is made of an aluminum material) in order to achieve a lightweight design of the wire harness, it has been commonly thought that it is impossible to electrically connect the cable 49 and the connection terminal together in a satisfactory and positive manner.

This will be described in detail. When the aluminum conductor 50 of the cable 49 is connected to the connection terminal made of a material different from the aluminum material, there is a fear that there is encountered a disadvantage that a potential difference or the like develops between the two, so that electric corrosion occurs.

And besides, when an aluminum material is used to form a connection spring piece (not shown) designed to ensure the positive electrical contact between the connection terminal and the mating terminal (not shown), there is a fear that this connection spring piece fails to produce a sufficient contact force for holding the connection terminal and the mating terminal in the positively electrically-connected condition, since the connection spring piece, made of the aluminum material, has insufficient spring properties. Therefore, there is a fear that the connection terminal is not kept in positive electrical contact with the mating terminal (not shown), so that the incomplete contact between the two occurs.

SUMMARY OF THE INVENTION

It is therefore an object of the present invention to provide a female terminal which is less susceptible to electric corrosion, and has an excellent connecting ability, and also to provide a connecting structure of this female terminal and a wire harness.

In order to achieve the above object, according to the present invention, there is provided a female terminal comprising:

a terminal body, comprised of a first material having excellent corrosion resistance; and an elastic piece, comprised of a second material having excellent spring properties, and the elastic piece mounting on the terminal body, wherein an engagement portion is formed on the terminal body;

wherein a retaining portion is formed on the elastic piece; and wherein the retaining portion is engaged with the engagement portion so that the elastic piece is mounted on the terminal body.

In the above construction, the terminal body of the female terminal is comprised of the first material having the excellent corrosion resistance, and therefore is prevented from being corroded by electric corrosion or the like. Also, the elastic piece of the female terminal is comprised of the second material having the excellent spring properties, and therefore when the female terminal is connected to the mating male terminal, the elastic piece of the female terminal produces a sufficient terminal contact force. And besides, the female terminal is constructed such that the elastic piece is mounted on the terminal body, with the retaining portion of the elastic piece engaged with the engagement portion of the terminal body, and therefore the terminal body and the elastic piece are prevented from being separated from each other.

Preferably, the first material is a non-ferrous metal material, and the second material is a ferrous metal material.

In the above construction, the terminal body of the female terminal is comprised of the non-ferrous metal material having the excellent corrosion resistance, and therefore the terminal body of the female terminal is prevented from being corroded by electric corrosion or the like, thereby preventing rust or the like from developing at the terminal body of the female terminal. Also, the elastic piece of the female terminal is comprised of the ferrous metal material having the excellent spring properties, and therefore when the female terminal is connected to the mating male terminal, the female terminal and the mating male terminal are positively connected together through the elastic piece in which a restoring elastic force inherent to the ferrous metal material is produced.

Preferably, the first material is an aluminum or an aluminum alloy, and the second material is at least one of stainless steel, spring steel, carbon steel and carbon tool steel.

In this construction, the terminal body of the female terminal is formed, using the aluminum or the aluminum alloy having the excellent corrosion resistance, and therefore the terminal body of the female terminal is protected by an oxide film formed on the aluminum body or the aluminum alloy body. Therefore, the terminal body of the female terminal is prevented from being corroded by electric corrosion or the like, thereby preventing a disadvantage that rust or the like develops on the surface of the terminal body of the female terminal. In addition, the specific gravity of the aluminum or the aluminum alloy is low, and therefore the lightweight design of the female terminal is achieved.

And besides, the elastic piece of the female terminal is formed, using the second material with the excellent spring properties which is at least one of stainless steel, spring steel, carbon steel and carbon tool steel. Therefore, when the female terminal is connected to the mating male terminal, the female terminal and the mating male terminal are positively kept in the electrically-connected condition through the elastic piece in which a restoring elastic force inherent to the steel is produced. And besides, the contact resistance between the female terminal and the mating male terminal is stable.

Furthermore, when the elastic piece of the female terminal is formed, using the stainless steel, the elastic piece of the female terminal is protected by an oxide film formed on the stainless steel body, and therefore there is provided the female terminal more excellent in corrosion resistance.

Preferably, the engagement portion is an engagement hole having a generally curved shape, and the retaining portion is a retaining protrusion having a generally curved shape.

In the above construction, the engagement hole in the terminal body and the retaining protrusion on the elastic piece provide an excellent assembling ability and an excellent strength.

Preferably, the terminal body includes:

an insertion port through which the elastic piece is inserted into the terminal body; and a receiving chamber, receiving the elastic piece therein; wherein the elastic piece includes:

a first contact portion, extending from the insertion port into the receiving chamber so as to electrically contact a male terminal;

a folded portion, folded back within the receiving chamber toward the insertion port; and a second contact portion, extending from the folded portion toward the insertion port so as to electrically contact the male terminal.

In the above construction, the terminal body of the female terminal includes the insertion port through which the elastic piece can be inserted into the terminal body, and the receiving chamber for receiving the elastic piece therein, and therefore the elastic piece can be easily mounted in the terminal body. The elastic piece for mounting in the terminal body of the female terminal includes the one contact portion extending from the insertion port into the receiving chamber so as to electrically contact the mating male terminal, the folded portion folded back within the receiving chamber toward the insertion port, and the other contact portion extending from the folded portion toward the insertion port so as to electrically contact the mating male terminal. Therefore, when the female terminal and the mating male terminal are connected together, the elastic piece, inserted in the receiving chamber of the female terminal, positively electrically contacts the mating male terminal at the one contact portion and the other contact portion.

According to the present invention, there is also provided a connecting structure of a female terminal, comprising;

the female terminal, includes:

a terminal body, comprised of a first material having excellent corrosion resistance; and an elastic piece, comprised of a second material having excellent spring properties, and the elastic piece mounting on the terminal body; and a cable secured to the female terminal, wherein a conductor of the cable is comprised of a third material belonging to the same kind of group as the material of the terminal body.

Preferably, the first material is a non-ferrous metal material, and the second material is a ferrous metal material.

Preferably, the first material is an aluminum or an aluminum alloy, and the second material is at least one of stainless steel, spring steel, carbon steel and carbon tool steel.

Preferably, an engagement portion is formed on the terminal body, a retaining portion is formed on the elastic piece, and the retaining portion is engaged with the engagement portion so that the elastic piece is mounted on the terminal body.

Here, it is preferable that, the engagement portion is an engagement hole having a generally curved shape, and the retaining portion is a retaining protrusion having a generally curved shape.

Preferably, the terminal body includes:

an insertion port through which the elastic piece is inserted into the terminal body; and a receiving chamber, receiving the elastic piece therein; wherein the elastic piece includes:

a first contact portion, extending from the insertion port into the receiving chamber so as to electrically contact a male terminal;

a folded portion, folded back within the receiving chamber toward the insertion port; and a second contact portion, extending from the folded portion toward the insertion port so as to electrically contact the male terminal.

In the above constructions, the contact resistance of the connected portion between the female terminal and the cable is stable. As a result, electric corrosion is prevented from developing at the connected portion between the female terminal and the cable.

Preferably, the third material is a non-ferrous metal material.

In the above construction, the connected portion between the terminal body of the female terminal and the conductor of the cable is prevented from being corroded by electric corrosion or the like, thereby preventing rust or the like from developing at the connected portion.

Preferably, the third material is an aluminum.

In the above construction, the conductor of the cable is protected by an oxide film formed on the aluminum conductor. Therefore, the connected portion between the terminal body of the female terminal and the conductor of the cable is prevented from being corroded by electric corrosion or the like, thereby preventing a disadvantage that rust or the like from developing at the connected portion. And besides, the specific gravity of the aluminum is low, and therefore the lightweight design of the cable is achieved.

According to the present invention, there is also provided a wire harness, comprising:

a plurality of female terminal, each includes:

a terminal body, comprised of a first material having excellent corrosion resistance; and an elastic piece, comprised of a second material having excellent spring properties, and the elastic piece mounting on the terminal body; and a plurality of cable secured to each of the female terminals, wherein the cables are combined into a bundle; and wherein a conductor of each of the cables is comprised of a material belonging to the same kind of group as the material of the terminal body.

Preferably, the third material is a non-ferrous metal material.

Preferably, the third material is an aluminum.

Preferably, the first material is a non-ferrous metal material, and the second material is a ferrous metal material.

Preferably, the first material is an aluminum or an aluminum alloy, and the second material is at least one of stainless steel, spring steel, carbon steel and carbon tool steel.

Preferably, an engagement portion is formed on the terminal body, a retaining portion is formed on the elastic piece, and the retaining portion is engaged with the engagement portion so that the elastic piece is mounted on the terminal body.

Here, it is preferable that, the engagement portion is an engagement hole having a generally curved shape, and the retaining portion is a retaining protrusion having a generally curved shape.

Preferably, the terminal body includes:

an insertion port through which the elastic piece is inserted into the terminal body; and a receiving chamber, receiving the elastic piece therein;

wherein the elastic piece includes:

a first contact portion, extending from the insertion port into the receiving chamber so as to electrically contact a male terminal;

a folded portion, folded back within the receiving chamber toward the insertion port; and a second contact portion, extending from the folded portion toward the insertion port so as to electrically contact the male terminal.

In the above construction, there is provided the wire harness of high connection reliability. And besides, when the conductor of each of the cables is comprised of aluminum belonging to the same kind of group as that of the material of the terminal body of the female terminal, the wire harness of a lightweight design can be provided since the aluminum has a low specific gravity.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

One preferred embodiment of the present invention will now be described in detail with reference to the drawings.

Figure 1:
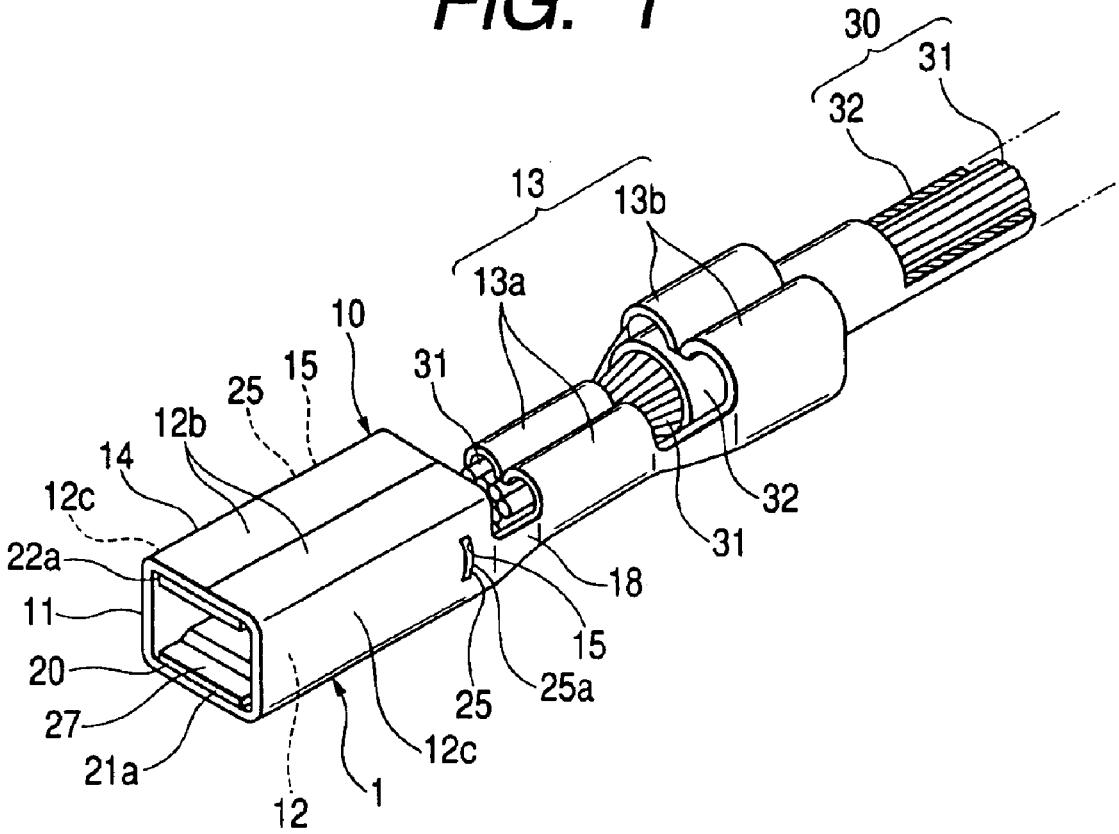
FIG. 1 is a perspective view showing one preferred embodiment of a female terminal of the invention, a connecting structure thereof and a wire harness of the invention.
Figure 2:
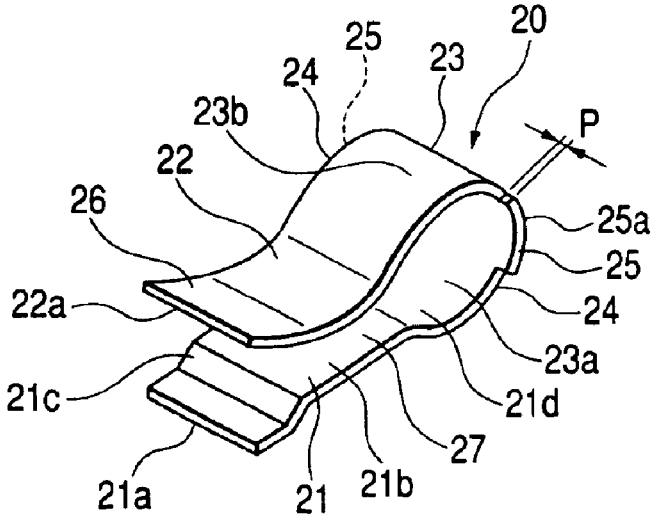
FIG. 2 is a perspective view showing the female terminal.

FIG. 1 is a perspective view showing one preferred embodiment of a female terminal of the invention, a connecting structure thereof and a wire harness of the invention. FIG. 2 is a perspective view showing the female terminal, and FIG. 3 is an explanatory view showing the female terminal, the connecting structure thereof and the wire harness.

First, various directions will be described with reference to FIGS. 1 and 3. In the female terminal 1, that side at which an insertion port 11 for the insertion of a mating male terminal 41 (FIG. 3) thereinto is formed is the front side, while that side to be connected to a cable 30 is the rear side. A direction of insertion of the mating male terminal 41 into the female terminal 1 is the terminal inserting direction E (FIG. 3). That side where a base wall 12*a* of a terminal body 10 of the female terminal 1 is provided is the lower side, while that side where another wall 12*b* is formed in substantially parallel, opposed relation to the base wall 12*a* is the upper side. The terms "front and rear" and "upper and lower" are defined merely for convenience' sake, and these defined directions do not always coincide with those in actual use of the female terminal, the connecting structure thereof and the wire harness.

Figure 3:
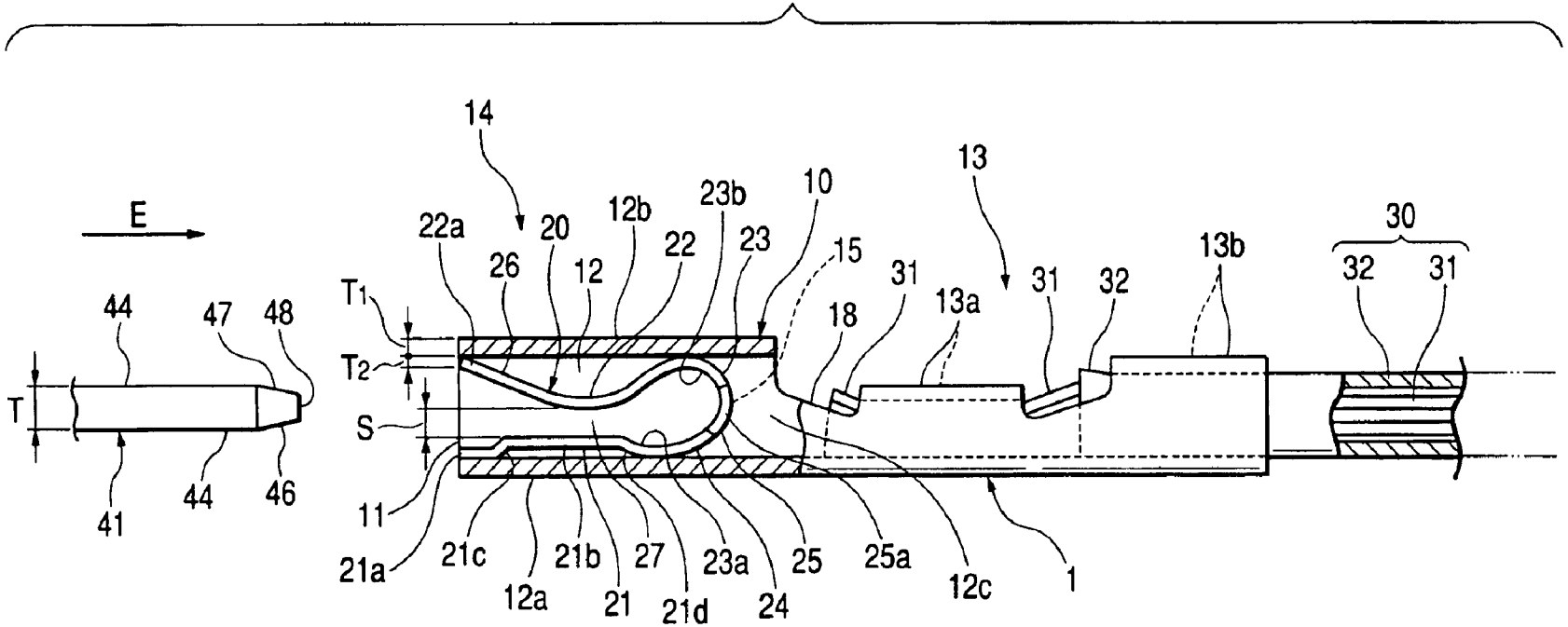
FIG. 3 is an explanatory view showing the female terminal, the connecting structure thereof and the wire harness.
Figure 4:
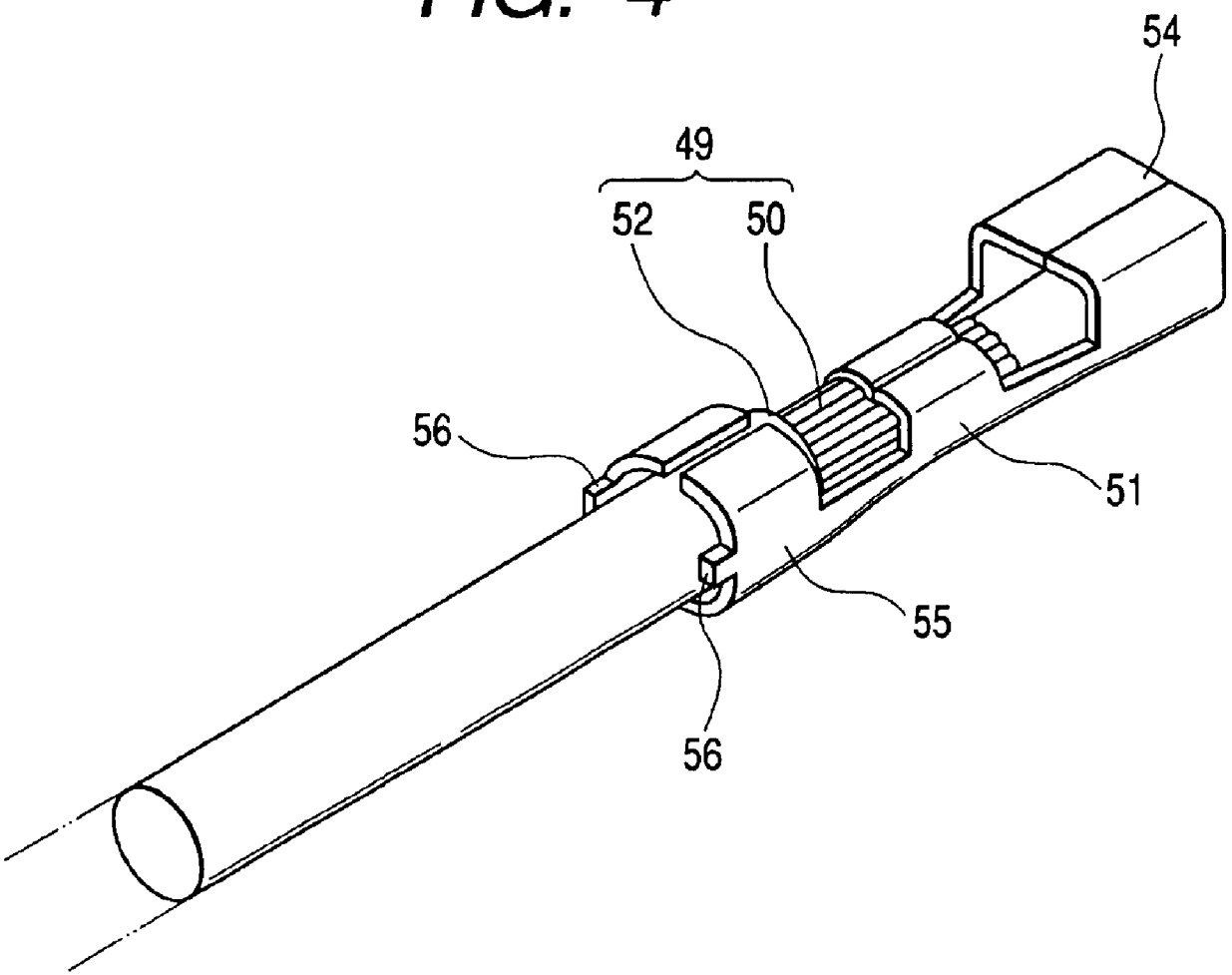
FIG. 4 is a perspective view showing one related electric connection member.

As shown in FIGS. 1 and 3, the female terminal 1 includes the terminal body 10, and an elastic piece 20 mounted in the terminal body 10. The elastic piece 20 is used as "a spring piece" or "a contact spring". The female terminal 1 includes an electrical contact portion 14 disposed at a front half portion of the terminal body 10, a wire connection portion 13 disposed at a rear half portion of the terminal body 1, and an interconnecting portion 18 interconnecting the electrical contact portion 14 and the wire connection portion 13.

The electrical contact portion 14, disposed at the front half portion of the female terminal 1, has the elastic piece 20 for contact purposes, and a receiving chamber 12 in which the elastic piece 20 and the mating male terminal 41 (FIG. 3) can be inserted. As shown in FIGS. 1 and 3, the wire connection portion 13, disposed at the rear half portion of the female terminal 1, includes a pair of conductor-lamping piece portions 13*a* for fixedly holding a conductor 31 of the cable 30 on the terminal body 10 of the female terminal 1, and a pair of sheath-clamping piece portions 13*b* for fixedly holding an insulating sheath 32 of the cable 30 on the terminal body 10 of the female terminal 1.

As shown in FIG. 1, when the pair of sheath-clamping piece portions 13*b* of the terminal body 1 of the female terminal 1 are press-fastened to the insulating sheath 32 of the cable 30, the insulating sheath 32 of the cable 30 and the female terminal 1 are positively fixed together. When the pair of conductor-clamping piece portions 13*a* of the terminal body 10 of the female terminal 1 are press-fastened to the conductor 31 of the cable 30, the conductor 31 of the cable 30 and the female terminal 1 are positively fixed together.

The terminal body 10 of the female terminal 1, shown in FIGS. 1 and 3, is made of a material having excellent corrosion resistance and excellent electrical conductivity. The elastic piece 20, shown in FIGS. 1 to 3, is made of a material having excellent spring properties and excellent electrical conductivity.

As shown in FIGS. 1 and 3, engagement portions 15 are formed at the terminal body 10, and retaining portions 25, corresponding to these engagement portions 15 of the terminal body 10, are formed at the elastic piece 20. As shown in FIGS. 1 and 3, the retaining portions 25 of the elastic piece 20 are engaged respectively with the engagement portions 15 of the terminal body 10, so that the elastic piece 20 is positively mounted in the terminal body 10.

Since the terminal body 10 of the female terminal 1 is made of the material which is excellent in corrosion resistance and electrical conductivity, the terminal body 10 of the female terminal 1 is prevented from being corroded by electric corrosion or the like. Also, the elastic piece 20, provided at the female terminal 1, is made of the material which is excellent in spring properties and electrical conductivity, and therefore when the female terminal 1 is connected to the mating male terminal 41 as shown in 3, the elastic piece 20 of the electrical contact portion 14 of the female terminal 1 produces a sufficient terminal contact force for an electrical contact portion 44 of the mating male terminal 41, so that the elastic piece 20 of the female terminal 1 positively grips the male terminal 41.

As shown in FIGS. 1 and 3, the female terminal 1 is constructed such that the elastic piece 20 is mounted in the terminal body 10, with the retaining portions 25 of the elastic piece 20 engaged respectively with the engagement portions 15 of the terminal body 10, and therefore the terminal body 10 and the elastic piece 20 are prevented from being separated from each other. Therefore, the elastic piece 20 is prevented from being accidentally disengaged from the terminal body 10, for example, during the process of producing the female terminal 1, thereby preventing a disadvantage that the elastic piece 20 of the female terminal 1 is lost.

A non-ferrous metal material is used as the material (excellent in 1s corrosion resistance and electrical conductivity) of which the terminal body 10 of the female terminal 1, shown in FIGS. 1 and 3, is made. Therefore, the terminal body 10 of the female terminal 1 is prevented from being corroded by electric corrosion or the like, and rust or the like is prevented from developing on the terminal body 10 of the female terminal 1.

A ferrous metal material is used as the material (excellent in spring properties and electrical conductivity) of which the elastic piece 20 for the female terminal, shown in FIGS. 1 to 3, is made Therefore, when the female terminal 1 is connected to the mating male terminal 41 as shown in 3, the elastic piece 20 produces a restoring elastic force inherent to the ferrous metal material, so that the elastic piece 20, provided within the female terminal 1, positively grips the male terminal 41, and the two are held in the mutually-contacted condition. Therefore, the female terminal 1 and the mating male terminal 41 are positively electrically connected together.

A non-ferrous metal material, selected from aluminum or an aluminum alloy, is used as the material having the excellent corrosion resistance and electrical conductivity, and the terminal body 10 of the female terminal 1, shown in FIGS. 1 and 3, is made of this selected material. Examples of pure aluminum materials include "1060" defined in "JIS H 4040" and the like. Examples of aluminum alloys include "6101" defined in "JIS H 4040" and the like. The aluminum ally, called "6101", includes aluminum (abbreviated as "Al") as a base material, and contains magnesium (abbreviated as "Mg") and silicon (abbreviated as "Si"), and this is commonly called the Al—Mg—Si aluminum alloy. The Al—Mg—Si aluminum alloy is the metal material having excellent corrosion resistance.

The surface of the terminal body 10 of the female terminal 1 is protected by an oxide film formed on the surface of the shaped body made of the above aluminum or the above aluminum alloy. Therefore, the terminal body 10 of the female terminal 1 is prevented from being corroded by electric corrosion or the like, thereby preventing a disadvantage that rust or the like develops on the surface of the terminal body 10 of the female terminal 1. In addition, the specific gravity of the aluminum or the aluminum alloy is low, and therefore the lightweight design of the female terminal 1 is achieved.

And besides, a ferrous metal material, which is one kind selected from the group consisting of stainless steel, spring steel, carbon steel and carbon tool steel, is used as the material having the excellent spring properties and electrical conductivity, and the elastic piece 20 for the female terminal, shown in FIGS. 1 to 3, is made of this selected material.

Examples of stainless steel include "SUS 302" defined in "JIS G 4305" and the like. Examples of spring steel include "SUP6" defined in "JIS G 4801" and the like. An example of carbon steel is carbon steel for machine construction, and a specific example thereof is "S55C" defined in "JIS G 4051". Examples of carbon tool steel include "SK3" defined in "JIS G 4401" and the like.

When the elastic piece 20 for the female terminal is made of any one of the above various ferrous metal materials, the elastic piece 20 produces a restoring elastic force inherent to the steel material when the female terminal 1 is connected to the mating male terminal 41 as shown in 3, so that the elastic piece 20, provided within the female terminal 1, positively grips the male terminal 41, and the two are positively contacted with each other to be electrically connected together. Therefore, the female terminal 1 and the mating male terminal 41 are kept in the positively electrically-connected condition. The elastic piece 20 of the female terminal, made of the ferrous metal material, may be plated with a corrosion-resistant substance such as gold, and this elastic piece 20 of the female terminal, having the enhanced corrosion resistance, is also effective.

When the elastic piece 20, provided within the female terminal 1, and the mating male terminal 41 are both made of the above materials belonging to the same kind of group, a potential difference between the elastic piece 20 of the female terminal 1 and the mating male terminal 41 is small, so that a contact resistance between the two is stable. Referring to an example of such combination, stainless steel is used to form the elastic piece 20 of the female terminal 1, and similarly stainless steel is used to form the mating male terminal 41.

When the elastic piece 20 in the female terminal 1 and the mating male terminal 41 are thus both formed, using the above materials belonging to the same kind of group, one contact portion 21 or another contact portion 22 of the elastic piece 20 of the female terminal 1 or the electrical contact portion 44 of the male terminal 44 is prevented from being corroded, thereby preventing rust or the like from developing on the one contact portion 21 or the other contact portion 22 of the elastic piece 20 of the female terminal 1, and also rust or the like is prevented from developing on the electrical contact portion 44 of the mating male terminal 41 For these reasons, the preferred combination is such that the elastic piece 20 in the female terminal 1 and the mating male terminal 41 are thus both formed, using the materials belonging to the same kind of group.

And besides, when the elastic piece 20 in the female terminal 1 is formed, using stainless steel, an oxide film, formed on the surface of the shaped body made of the stainless steel, protects the surface of the elastic piece 20 in the female terminal 1, and therefore there is obtained the female terminal 1 more excellent in corrosion resistance. Stainless steel is excellent in spring properties, and also is excellent in electrical conductivity, and therefore it is preferred to use stainless steel as the material for forming the female terminal 1.

When the male terminal 41 is formed, using a material (such as aluminum, an aluminum alloy or stainless steel) excellent in corrosion resistance and electrical conductivity, an oxide film, formed on the surface of the shaped body made of the aluminum, the aluminum alloy or the stainless steel, protects the surface of the male terminal 41. Therefore, it is preferred that the male terminal 41 be formed, using the metal material which is one kind selected from the group consisting of the aluminum, the aluminum alloy and the stainless steel. When the male terminal 41 is formed, using such a metal material, the male terminal 41 exhibits the excellent corrosion resistance and electrical conductivity.

The oxide film, developing on the surface of the shape body made of the aluminum, the aluminum alloy or the stainless steel, is formed in the air, so that the metal material is passivated. The term "passivation" means that corrosion of metal will not proceed though the metal is placed under a pasasivating condition. Even though the oxide film, formed on the surface of the shaped body made of the aluminum, the aluminum alloy or the stainless steel, may be destroyed in the air, this film immediately repairs the destroyed portion by itself. As a result, the internal metal continues to be protected.

In the dry air, a thin film, having a thickness of about 2.5 nm, is formed on the surface of the shaped body of aluminum, and this thin film is composed of amorphous alumina ($Al_2O_3$). A thin film, having a thickness of about 1 nm to about 3 nm, is formed on the surface of the shaped body of stainless steel, and this thin film contains chromium. The thin film, formed on the surface of the shaped body of stainless steel, is transparent, and therefore the surface of the shaped body of stainless steel will not lose a metallic luster forever.

Aluminum and an aluminum alloy are materials having excellent workability. With respect to a combination of a product, formed of aluminum, an aluminum alloy or stainless steel, and a product similarly formed of aluminum, an aluminum alloy or stainless steel, both of them are excellent in corrosion resistance and electrical conductivity. Therefore, for example, a combination of the terminal and the mating terminal, as well as a combination of the terminal and the conductor of the wire for connection to the terminal, is a good combination. One or more necessary additives may be included in any one of the above various metal materials.

As shown in FIGS. 1 and 3, each of the engagement portions 15, formed respectively in opposite side walls 12*c* of the terminal body 10 of the female terminal 1, is in the form of an engagement hole 15 of a generally curved shape. As shown in FIGS. 1 to 3, each of the retaining portions 25 (corresponding respectively to the engagement holes 15 formed respectively in the opposite side walls 12*c* of the terminal body 10 of the female terminal 1), formed respectively at opposite side edges 24 (FIG. 2) of the elastic piece 20 of the female terminal 1, is in the form of a retaining protrusion 25 of a generally curved shape. With this construction, the engagement holes 15 in the terminal body 10 and the retaining protrusions 25 on the elastic piece 20 provide an excellent assembling ability and an excellent strength.

As shown in FIGS. 2 and 3, the pair of generally-curved retaining protrusions 25 are formed on and project respectively from the opposite side edges 24 (FIG. 2) of a folded portion 23 of the elastic piece 20 folded back into a generally curved shape. As shown in FIGS. 2 and 3, the two generally-curved retaining protrusions 25 correspond in curvature to the curved folded portion 23 of the elastic piece 20.

As shown in FIGS. 1 and 3, the retaining protrusions 25, formed respectively at the opposite side edges 24 of the elastic piece 20 shown in FIG. 2, are fitted respectively in the engagement holes 15 formed respectively in the opposite side walls 12*c* of the terminal body 10 of the female terminal 1. When the elastic piece 20 is mounted in the terminal body 10 of the female terminal 1 as shown in FIG. 1, outer side edges 25*a* of the retaining protrusions 25, formed on the elastic piece 20, do not project outwardly respectively from the opposite side walls 12*c* of the terminal body 10 of the female terminal 1, but are located respectively in the engagement holes 15 formed respectively in the opposite side walls 12*c* of the terminal body 10 of the female terminal 1.

A length P (FIG. 2) of projecting of each retaining protrusion 25 from the corresponding side edge 24 of the elastic piece 20 is smaller than a thickness $T_1$ (FIG. 3) of the sheet material forming the terminal body 10. The projecting length P of each retaining protrusion 25 on the elastic piece 20 is smaller than the thickness of the side wall 12*c* of the rectangular box-like peripheral wall of the terminal body 10.

With this construction, the retaining protrusions 25 of the elastic piece 20 will not project outwardly respectively from the opposite side walls 12*c* of the rectangular box-like peripheral wall of the terminal body 10 of the female terminal 1. Therefore, a space-saving effect is achieved around the female terminal 1, and therefore a connector housing (not shown) for receiving the female terminal 1 therein can be formed into a small size. Therefore, there can be provided a connector (not shown) which has a small-size design and excellent connectability.

Each retaining portion 25, formed on the elastic piece 20 of the female terminal, is not limited to the above shape, and the retaining portion 25, formed on the elastic piece 20 of the female terminal, may be in the form of a retaining projection.

As shown in FIG. 3, one end portion 21*a* of the elastic piece 20 is held against the base wall 12*a* of the terminal body 10, and the other end portion 22*a* of the elastic piece 20 is held against the wall 12*b* of the terminal body 10 opposed to the base wall 12*a*, and the curved retaining protrusions 25 of the elastic piece 20 are fitted respectively in the curved engagement holes 15 formed respectively in the opposite side walls 12*c* of the terminal body 10. Therefore, even if a gouging engagement accidentally tends to occur when the mating male terminal 41 is inserted into the female terminal 1 in the terminal inserting direction E so as to be electrically connected to the female terminal 1, the elastic piece 20 will not move relative to the terminal body 10, and this elastic piece 20 is held in the terminal body 10 in a suitably elasticly-deformed condition.

In order to more positively prevent the gouging, there can be used an effective construction in which one portion 23*a* of the curved folded portion 23 of the elastic piece 20 is held against the base wall 12*a* of the terminal body 10. Also, there can be used an effective construction in which another portion 23*b* of the curved folded portion 23 of the elastic piece 20 is held against the wall 12*b* of the terminal body 10 opposed to the base wall 12*a*.

The terminal body 10 of the female terminal 1, shown in FIGS. 1 and 3, includes the insertion port 11 (FIGS. 1 and 3) of a generally rectangular shape (through which the elastic piece 20 (shown in FIGS. 2 and 3) can be inserted into the terminal body 10), and the receiving chamber 12 (FIGS. 1 and 3) of a generally rectangular box-shape for receiving the elastic piece 20 (shown in FIGS. 2 and 3) therein.

The receiving chamber 12 of the terminal body 10, included in the electrical contact portion 14 of the female terminal 1, is defined by the base wall 12*a* of the terminal body 10 of the female terminal 1, the wall 12*b* disposed in substantially parallel, opposed relation to the base wall 12, and the pair of side walls 12*c* which interconnect the base wall 12*a* and the wall 12*b*, and are disposed substantially perpendicular to the base wall 12*a* and the wall 12*b*. As shown in FIG. 1, the wall 12 of the terminal body 10 of the female terminal 1 is formed by bending extension portions of the pair of side walls 12*c* at substantially right angles. The terminal body 10 has the receiving chamber 12, and therefore the elastic piece 20 can be easily mounted in the receiving chamber 12 of the terminal body 10 of the female terminal 1.

The elastic piece 20, mounted within the terminal body 10 of the female terminal 1 shown in FIGS. 1 and 3, includes the generally-flat one contact portion 21 (FIGS. 2 and 3) extending from the insertion port 11 of the female terminal 1 into the receiving chamber 12 as shown in FIG. 3 so as to electrically contact the mating tab-like male terminal 41, the generally-curved folded portion 23 folded back within the receiving chamber 12 of the terminal body 10 toward the insertion port 11 as shown in FIG. 3, and the generally gently-curved other contact portion 22 (FIGS. 2 and 3) extending from the folded portion 23 toward the insertion port 11 of the female terminal 1 (as shown in FIG. 3) for electrical contact with the mating tab-like male terminal 41. The other contact portion 22 of the elastic piece 20 is formed at an elastic contact piece portion 26 of a generally curved shape.

The elastic piece 20 of such a shape for the female terminal 1 is provided, and therefore when the female terminal 1 is connected to the mating tab-like male terminal 41 as shown in FIG. 3, the elastic piece 20, inserted in the receiving chamber 12 of the terminal body 10 of the female terminal 1, positively electrically contacts the mating tab-like male terminal 41 at the generally-flat one contact portion 21 and the gently-curved other contact portion 22. Namely, the mating tab-like male terminal 41 is held between the one contact portion 21 and the other contact portion 22 of the elastic piece 20 provided in the female terminal 1, so that the female terminal 1 and the mating tab-like male terminal 41 are positively kept in the electrically-connected condition for a long period of time.

More specifically, when the mating tab-like male terminal 41 is inserted into the female terminal 1 in the terminal inserting direction E, and is electrically connected thereto, the elastic contact piece portion 26 of "the spring piece" 20 is pressed toward the wall 12*b* of the terminal body 10 by the mating tab-like male terminal 41.

As a result, the elastic contact piece portion 26 of "spring piece" 20 produces a restoring elastic force, so that the mating tab-like male terminal 41 is positively held between the one contact portion 21 and the other contact portion 22 of "the spring piece" 20 mounted within the terminal body 10 of the female terminal 1. Thus, the mating tab-like male terminal 41 is located in a space portion 27 in "the spring piece" 20 mounted in the terminal body 10 of the female terminal 1. In order that the mating tab-like male terminal 41 can be easily inserted into the rectangular box-like receiving chamber 12, slanting guide surfaces 46, 47 and 48 are formed at the distal end portion of the mating tab-like male terminal 41 as shown in FIG. 3.

In order that when the female terminal 1 and the mating tab-like male terminal 41 are to be electrically connected together, the one contact portion 21 of "the spring piece" 20, mounted in the terminal body 10 of the female terminal 1, can be suitably elasticly deformed. Thereby suppressing the gouging and enabling the male-female connection with a good feeling, slanting portions 21*c* and 21*d* are formed respectively at front and rear ends of a flat portion 21*b* of the one contact portion 21 of "the spring piece" 20. The flat portion 21*b* of the one contact portion 21 of "the spring piece" 20 is held out of contact with the base wall 12*a* of the terminal body 10 of the female terminal 1.

In order that the mating tab-like male terminal 41 can be positively electrically connected to the female terminal 1, a thickness T of the mating tab-like male terminal 41 is larger than a minimum gap S between the one contact portion 21 and the other contact portion 22 of "the spring piece" 20 (mounted in the terminal body 10 of the female terminal 1) in a natural condition as shown in FIG. 3.

In order that when the mating tab-like male terminal 41 is positively electrically connected to the female terminal 1, "the spring piece" 20, mounted in the terminal body 10 of the female terminal 1, can be suitably elasticly deformed so as to positively grip the mating tab-like male terminal 41, a thickness $T_2$ of the sheet, forming "the spring piece" 20, is smaller than the thickness $T_1$ of the sheet forming the terminal body 10.

As shown in FIGS. 1 and 3, the female terminal 1 is secured to the distal end portion of the cable 30. The conductor 31 of the cable 30 is formed, using the material belonging to the same kind of group as that of the material of the terminal body 10 of the female terminal 1. With this design, the potential difference between the conductor-clamping piece portions 13*a* of the female terminal 1 and the conductor 31 of the distal end portion of the cable 30 is small, so that the contact resistance between the two is stable. As a result, electric corrosion is prevented from developing at the conductor-lamping piece portions 13*a* of the terminal body 10 of the female terminal 1, and also electric corrosion is prevented from developing at the exposed conductor 31 at the distal end portion of the cable 30.

The conductor 31 of the cable 30, extending from the terminal body 10 of the female terminal 1, is protected by the insulating sheath 32, made of a vinyl chloride polymer or the like, so that the conductor will not be adversely affected by electric leakage, noises or the like.

The conductor 31 of the cable 30 is made of the material with the excellent corrosion resistance and electrical conductivity which belongs to the same kind of group as that of the material of the terminal body 10 of the female terminal 1. More specifically, the conductor 31 of the cable 30 is made of the non-ferrous metal material which belongs to the same kind of group as that of the material of the terminal body 10 of the female terminal 1.

Since the conductor 31 of the cable 30 is made of the material which belongs to the same kind of group as that of the material of the terminal body 10 of the female terminal 1, electric corrosion due to the potential difference is prevented from developing at the connected portion where the terminal body 10 of the female terminal 1 and the conductor 31 of the cable 30 contact each other, and therefore those portions of the terminal body 10 (of the female terminal 1) and the conductor 31 (of the cable 30), contacted with each other, are prevented from being corroded, so that rust or the like is prevented from developing at the connected portion between the two.

The conductor 31 of the cable 30 is made of the aluminum material (non-ferrous metal material) which belongs to the same kind of group as that of the material of the terminal body 10 of the female terminal 1. One example of such conductor is an electric hard-drawn aluminum wire defined in "JIS C 3108". Since the conductor 31 of the cable 30 is formed, using the aluminum material, the surface of the conductor 31 of the cable 30 is protected by an oxide film formed on the surface of the shaped body of the aluminum material.

Therefore, the conductor-clamping piece portions 13*a* of the terminal body 10 of the female terminal 1 are prevented from being corroded by electric corrosion or the like, thus preventing rust or the like from developing at this portion, and also the exposed conductor 31 at the distal end portion of the cable 30 is prevented from being corroded by electric corrosion or the like, thus preventing rust or the like from developing at this portion.

With respect to a more preferred combination, the terminal body 10 of the female terminal 1 and the conductor 31 of the cable 30 are both formed, using the same kind of material. Referring to one specific example of such combination, the terminal body 10 of the female terminal 1 is formed, using the aluminum material, and similarly the conductor 31 of the cable 30 is formed, using the aluminum material, and the two are electrically connected together.

The female terminals 1, shown in FIGS. 1 and 3, are inserted into the connector housing (not shown) to form the connector (not shown), and a plurality of cables 30, having a connector (not shown), are prepared, and the plurality of cables 30 are combined into a bundle by a bundling member such as a binding tape (not shown) or a corrugated tube (not shown) with a longitudinal slit Thus, the plurality of cables 30 are assembled into a unitary construction, thereby forming one assembly wire, that is, a so-called wire harness. The wire harness is formed, using the female terminals 1 or the cables 30 each having the female terminal 1 connected thereto, and therefore there is provided the wire harness of high connection reliability.

The specific gravity of an aluminum material is lower than the specific gravity of general-purpose metal materials, and therefore when the terminal body 10 of the female terminal 1 is made of the aluminum material selected from the aluminum or the aluminum alloy, and the conductor 31 of the cable 30 is made of an aluminum wire selected from the aluminum or the aluminum alloy, the lightweight design of the cable 30, having the female terminal secured thereto, is achieved, and therefore there can be provided the wire harness of a lightweight design.

What is claimed is:

1. A female terminal comprising:

a terminal body, comprised of a first conductive material having excellent corrosion resistance and being electrically connectable to a cable; and an elastic piece, comprised of a second conductive material having excellent spring properties, the elastic piece being mounted on the terminal body, wherein an engagement portion is formed on the terminal body;

wherein a retaining portion is formed on the elastic piece; and wherein the retaining portion is engaged with the engagement portion so that the elastic piece is mounted on the terminal body.

2. The female terminal as set forth in claim 1, wherein the first conductive material is a non-ferrous metal material; and wherein the second conductive material is a ferrous metal material.

3. The female terminal as set forth in claim 1, wherein the first conductive material is an aluminum or an aluminum alloy; and wherein the second material is at least one of stainless steel, spring steel, carbon steel and carbon tool steel.

4. The female terminal as set forth in claim 1, wherein the engagement portion is an engagement hole having a generally curved shape; and wherein the retaining portion is a retaining protrusion having a generally curved shape.

5. The female terminal as set forth in claim 1, wherein the terminal body includes:

an insertion port through which the elastic piece is inserted into the terminal body; and a receiving chamber, receiving the elastic piece therein;

wherein the elastic piece includes:

a first contact portion, extending from the insertion port into the receiving chamber so as to electrically contact a male terminal;

a folded portion, folded back within the receiving chamber toward the insertion port; and a second contact portion, extending from the folded portion toward the insertion port so as to electrically contact the male terminal.

6. A connecting structure of a female terminal, comprising:

the female terminal, includes:

a terminal body, comprised of a first conductive material having excellent corrosion resistance; and an elastic piece, comprised of a second conductive material having excellent spring properties, the elastic piece being mounted on the terminal body; and a cable secured to the female terminal, wherein a conductor of the cable is comprised of a third conductive material belonging to the same kind of group as the material of the terminal body.

7. The connecting structure of the female terminal as set forth in claim 6, wherein the third conductive material is a non-ferrous metal material.

8. The connecting structure of the female terminal as set forth in claim 6 wherein the third conductive material is an aluminum.

9. The connecting structure of the female terminal as set forth in claim 6, wherein the first conductive material is a non-ferrous metal material; and wherein the second conductive material is a ferrous metal material.

10. The connecting structure of the female terminal as set forth in claim 6, wherein the first conductive material is an aluminum or an aluminum alloy; and wherein the second conductive material is at least one of stainless steel, spring steel, carbon steel and carbon tool steel.

11. The connecting structure of the female terminal as set forth in claim 6, wherein an engagement portion is formed on the terminal body;

wherein a retaining portion is formed on the elastic piece; and wherein the retaining portion is engaged with the engagement portion so that the elastic piece is mounted on the terminal body.

12. The connecting structure of the female terminal as set forth in claim 11, wherein the engagement portion is an engagement hole having a generally curved shape; and wherein the retaining portion is a retaining protrusion having a generally curved shape.

13. The connecting structure of the female terminal as set forth in claim 6, wherein the terminal body includes:

an insertion port through which the elastic piece is inserted into the terminal body; and a receiving chamber, receiving the elastic piece therein;

wherein the elastic piece includes:

a first contact portion, extending from the insertion port into the receiving chamber so as to electrically contact a male terminal;

a folded portion, folded back within the receiving chamber toward the insertion port; and a second contact portion, extending from the folded portion toward the insertion port so as to electrically contact the male terminal.

14. A wire harness, comprising:

a plurality of female terminal, each includes:

a terminal body, comprised of a first material having excellent corrosion resistance; and an elastic piece, comprised of a second material having excellent spring properties, and the elastic piece mounting on the terminal body; and a plurality of cable secured to each of the female terminals, wherein the cables are combined into a bundle; and wherein a conductor of each of the cables is comprised of a material belonging to the same kind of group as the material of the terminal body.

15. The wire harness as set forth in claim 14, wherein the third material is a non-ferrous metal material.

16. The wire harness as set forth in claim 14 wherein the third material is an aluminum.

17. The wire harness as set forth in claim 14, wherein the first material is a non-ferrous metal material; and wherein the second material is a ferrous metal material.

18. The wire harness as set forth in claim 14, wherein the first material is an aluminum or an aluminum alloy; and wherein the second material is at least one of stainless steel, spring steel, carbon steel and carbon tool steel.

19. The wire harness as set forth in claim 14, wherein an engagement portion is formed on the terminal body;

wherein a retaining portion is formed on the elastic piece; and wherein the retaining portion is engaged with the engagement portion so that the elastic piece is mounted on the terminal body.

20. The wire harness as set forth in claim 19, wherein the engagement portion is an engagement hole having a generally curved shape; and wherein the retaining portion is a retaining protrusion having a generally curved shape.

21. The wire harness as set forth in claim 14, wherein the terminal body includes:

an insertion port through which the elastic piece is inserted into the terminal body; and a receiving chamber, receiving the elastic piece therein;

wherein the elastic piece includes:

a first contact portion, extending from the insertion port into the receiving chamber so as to electrically contact a male terminal;

a folded portion, folded back within the receiving chamber toward the insertion port; and a second contact portion, extending from the folded portion toward the insertion port so as to electrically contact the male terminal.

* * * * *